United States Patent [19]

Rice

[11] Patent Number: 4,660,772

[45] Date of Patent: Apr. 28, 1987

[54] ELECTROSTATIC POWDER SPRAY GUN NOZZLE

[75] Inventor: Kenneth T. Rice, Lima, Ohio

[73] Assignee: A. O. Smith Corporation, Milwaukee, Wis.

[21] Appl. No.: 654,710

[22] Filed: Sep. 26, 1984

[51] Int. Cl.[4] ..... B05B 5/02

[52] U.S. Cl. ..... 239/704; 239/490; 406/92

[58] Field of Search ..... 239/489, 490, 704–708; 406/92, 191

[56] References Cited

U.S. PATENT DOCUMENTS

| | | | |
|---|---|---|---|
| Re. 23,413 | 10/1951 | Bete | 239/130 |
| 1,784,503 | 12/1930 | Swann | 239/489 |
| 2,706,942 | 4/1955 | Caldwell | 98/40 |
| 2,862,522 | 12/1958 | Yost | 138/37 |
| 2,984,421 | 5/1961 | Hession | 239/406 |
| 3,117,821 | 1/1964 | Mylting | 406/191 |
| 3,228,661 | 1/1966 | Rose | 259/3 |
| 3,275,248 | 9/1966 | O'Brien et al. | 239/487 |
| 3,353,752 | 11/1967 | Ranhagen et al. | 239/538 |
| 3,590,318 | 6/1971 | Probst et al. | 317/3 |
| 3,617,000 | 11/1971 | Probst | 239/706 |
| 3,666,183 | 5/1972 | Smith | 239/463 |
| 3,711,022 | 1/1973 | Witte | 239/15 |
| 3,737,099 | 6/1973 | Shaffer | 239/707 |
| 3,740,612 | 6/1973 | Gauthier et al. | 317/3 |
| 3,746,254 | 7/1973 | Duncan et al. | 239/15 |
| 3,819,115 | 6/1974 | Soderman | 239/15 |
| 3,844,477 | 10/1974 | Pollard et al. | 239/15 |
| 4,014,470 | 3/1977 | Burnham | 239/472 |
| 4,380,320 | 4/1983 | Hollstein et al. | 239/697 |
| 4,406,407 | 9/1983 | Aprea et al. | 239/487 |
| 4,515,314 | 5/1985 | Currall | 239/489 |

FOREIGN PATENT DOCUMENTS

| | | | |
|---|---|---|---|
| 3038596 | 4/1982 | Fed. Rep. of Germany | 239/690 |

*Primary Examiner*—Andres Kashnikow

*Attorney, Agent, or Firm*—Andrus, Sceales, Starke & Sawall

[57] ABSTRACT

An electrostatic powder spray gun is provided with an arcuate nozzle tube forming a curved passage between an inlet and outlet orifice. A mixture of powder particles and a carrier gas injected into the inlet orifice is subjected to a swirling motion prior to exiting the outlet orifice. This swirling motion is caused by helical grooves cut into the inside surface of the arcuate tube adjacent to the outlet orifice. An electrode imparts an electrical charge to the particles as they exit from the nozzle tube.

3 Claims, 3 Drawing Figures

ELECTROSTATIC POWDER SPRAY GUN NOZZLE

BACKGROUND OF THE INVENTION

This invention relates to electrostatic spray coating and more particularly to a nozzle for a powder spray gun.

In the application of powder coating material to objects in industrial finishing applications, a powder material such as an epoxy or polyester is mixed with an air carrier and is dispensed from a gun in the form of a spray which is projected toward the object to be coated. As the particulate coating material is dispensed from a gun, the particles are imparted with an electrical charge so that they will be electrostatically attracted toward the object to be coated which is generally held at ground potential. After coating, the object may be heated at bake the coating material onto its surface.

Generally, paint powder is fluidized with air and the resulting mixture is transported to a powder distribution device which disperses a plume or cloud of powder around the object to be painted. The powder containing air stream is usually contained in rubber or plastic tubing which bends easily. As the air stream travels around a bend, centrifugal force tends to force the powder toward the outside of the bend. This can result in streaming where the finely granulated material travels in a high density column in only one portion of the total air stream being used for transport. Since the powder must be evenly distributed to achieve a uniform coating, streaming is particularly objectionable when the last bend in the tube is close to the powder dispersal point.

SUMMARY OF THE INVENTION

An electrostatic spray gun nozzle for spraying particulate powder material constructed in accordance with the present invention comprises:

- an arcuate tube haing an inlet orifice and an outlet orifice;
- means for injecting a mixture of powder particles and a gas into the inlet orifice; and
- a plurality of helical grooves in the inside wall of the tube, for imparting a swirling motion to the mixture to prevent streaming of the powder particles, wherein the grooves extend along a portion of the inside wall of the tube adjacent to the outlet orifice.

The curved nozzle of the present invention is particularly suited for powder paint systems which are used to coat the interior surface of a cup-shaped structure such as the end bell of an electric motor. With a curved nozzle, the powder plume can be easily directed toward the interior of the cup-shaped structure which is to be coated.

DESCRIPTION OF THE PREFERRED EMBODIMENT

Figure 1:
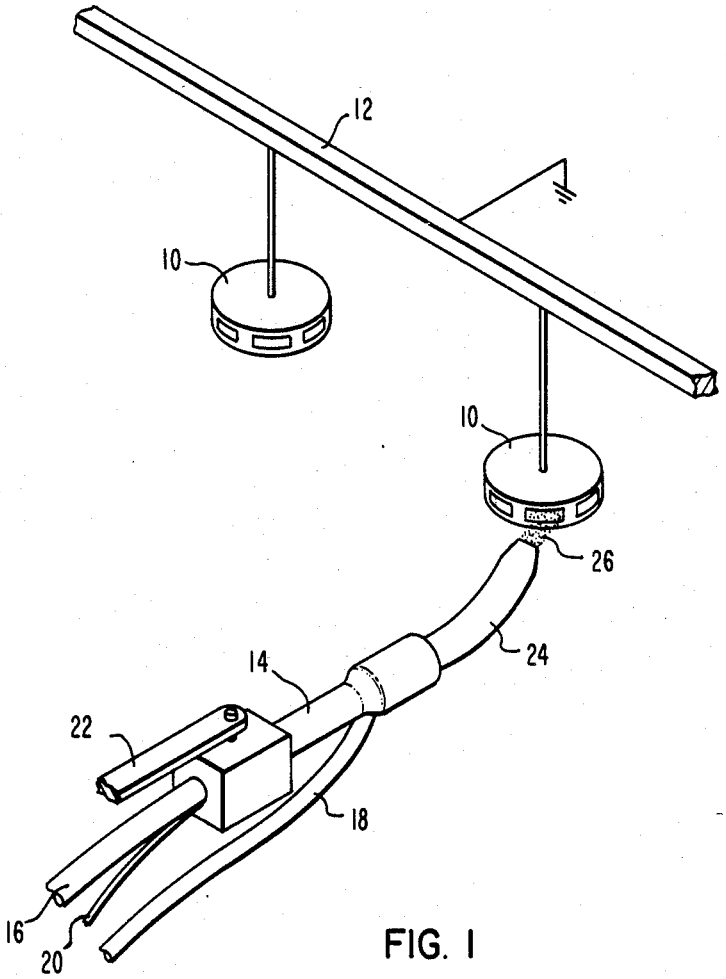
FIG. 1 is a pictorial representation of a powder paint system employing a spray gun having a nozzle constructed in accordance with one embodiment of the present invention.

Referring to the drawings, FIG. 1 is a pictorial representation of an electrostatic powder painting system employing a nozzle constructed in accordance with one embodiment of the present invention. In this system, a series of cup-like structures in the form of electric motor end bells 10 are transported on a moveable conveyor 12 past a powder paint spray gun which includes the nozzle of this invention. A conventional powder paint spray gun 14 which may be, for example, a Nordson Corporation Model NPE-2M or NPE-2A, is constructed in accordance with known technology and includes a first tube 16 for supplying a carrier gas such as air and a second tube 18 for supplying the paint powder. Cable 20 connects a source of high voltage to an electrode which is used to place an electrostatic charge on the powder particles in a known matter. A support rod 22 is used to hold the powder spray gun in an appropriate position relative to the items to be coated. The powder spray gun 14 serves as a means for injecting a mixture of powder particles and a gas into the nozzle 24 of this invention. This mixture 26 is directed by nozzle 24 past an electrical charging electrode and then onto the item to be coated.

Figure 2:
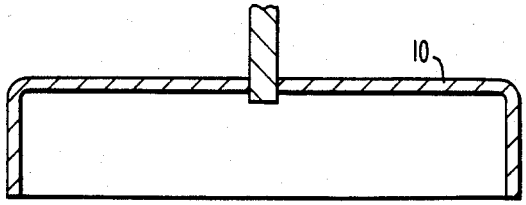
FIG. 2 is a cross-sectional view of the powder spray gun nozzle of FIG. 1.
Figure 2:
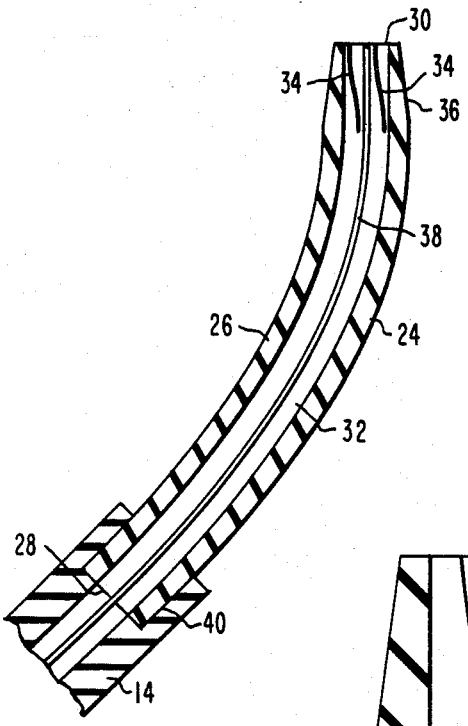

FIG. 2 is a cross-sectional view of the nozzle 24 of FIG. 1. In this view, nozzle 24 can be seen to include an arcuate tube 26 having an inlet orifice 28 and an outlet orifice 30. This tube which may be made of any suitable non-conducting material, defines a passage 32 having a substantially constant diameter, circular cross-section along its length between the inlet and outlet orifices. The passage has a substantially circular cross section with a substantially constant diameter throughout its entire length. A plurality of helical grooves 34 have been cut into the inside wall of tube 26 to impart a swirling motion to the powder particle and gas mixture to prevent streaming of the powder particles. These grooves extend along a portion of the inside wall of the tube adjacent to the outlet orifice 30. The tube 26 is also shown to include a tapered section 36 and a central electrode 38 which is used to impart an electrical charge to the powder particles as they exit the nozzle. The nozzle tube is attached to the spray gun 14 by means of an interference fit 40.

Figure 3:
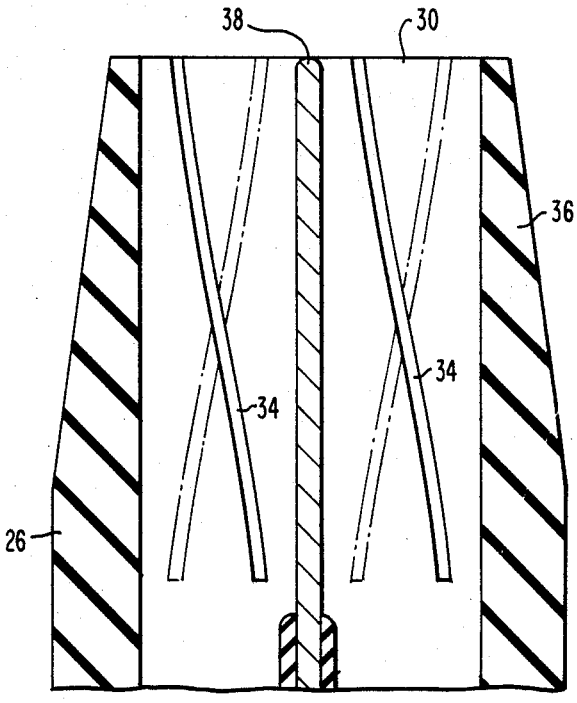
FIG. 3 is an enlarged cross-sectional view of a portion of the nozzle of FIG. 2, showing the helical grooves located adjacent to the outlet orifice.

FIG. 3 is an enlarged cross-sectional view of a portion of the nozzle tube 26 adjacent to the outlet orifice 30. In this view, the swirl imparting helical grooves 34 can be seen to be impressed upon the interior surface of the tube 26. These grooves are similar to the rifling in a rifled firearm. The charging electrode 38 is centrally mounted within the nozzle tube in accordance with known technology which may include splines extending from the electrode to the wall of the tube.

A curved nozzle for an electrostatic powder paint applying system has been constructed in accordance with this invention utilizing an 8 inch tube bent along a 9 inch radius of curvature and having a $\frac{5}{8}$ inch inside diameter. This tube has sufficient curvature such that the powder particles are subjected to a centrifugal force as they pass through the tube, which tends to force the particles to one side of the tube. Rifling grooves having a depth of 0.02 inches and a pitch of one turn in 12 inches were cut over a $1\frac{1}{2}$ inch length of the tube 26 adjacent to the outlet orifice 30. The helical grooves of this nozzle structure have been shown to eliminate streaming in a particular epoxy powder paint application using an Armstrong epoxy Type 30000 with a particle size blend to yield a 0.001 inch thick coating on the product, with air and powder flow rates and charge voltage adjusted at the operator's discretion.

The nozzle of this invention has been shown to eliminate streaming through the use of a relatively simple structure to provide an acceptable coating on a cup-shaped product.

Although the present invention has been described in terms of what is at present believed to be its preferred embodiment, it will be apparent to those skilled in the art that various changes may be made without departing from the scope of this invention. It is therefore intended that the appended claims cover all such changes.

What is claimed is:

1. An electrostatic spray gun for spraying particulate powder material comprising:

an elongated arcuate tube nozzle having an inlet orifice and an elongated outlet orifice, said tube having a curved portion adjacent to said elongated outlet orifice to define a continuously turning flow path adjacent and into said outlet orifice, said outlet orifice having a length substantially less than said curved portion of said nozzle;

means for injecting a mixture of powder particles and a gas into said inlet orifice and establishing flow through said tube nozzle with a smooth turning of said flow into said outlet orifice, said curvature of said curved portion forcing said powder particles passing through said curved portion to one side of said tube nozzle as a result of centrifugal forces;

means to impart a charge to said powder particles passing through said outlet orifice; and a plurality of circumferentially spaced helical grooves in the inside wall of said tube, each of said grooves extending substantially throughout said outlet orifice for imparting a small circumferential swirling motion to said mixture to prevent streaming of said powder particles, said grooves extending along a portion of the inside wall of said tube adjacent to and substantially throughout said outlet orifice.

2. An electrostatic spray gun as recited in claim 1, wherein said arcuate tube defines a passage between said inlet orifice and said outlet orifice, said passage having a substantially circular cross section with a substantially constant diameter throughout the length of said passage.

3. An electrostatic spray gun as recited in claim 1, wherein said arcuate tube is made of an electrical insulating material.

* * * * *